US009759238B2

(12) United States Patent
Ku

(10) Patent No.: US 9,759,238 B2
(45) Date of Patent: Sep. 12, 2017

(54) HYDRAULIC CONTROL VALVE FOR CONSTRUCTION MACHINERY

(75) Inventor: Bon-Seuk Ku, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 389 days.

(21) Appl. No.: 14/419,829

(22) PCT Filed: Aug. 16, 2012

(86) PCT No.: PCT/KR2012/006507
§ 371 (c)(1),
(2), (4) Date: Feb. 5, 2015

(87) PCT Pub. No.: WO2014/027706
PCT Pub. Date: Feb. 20, 2014

(65) Prior Publication Data

US 2015/0204360 A1 Jul. 23, 2015

(51) Int. Cl.
*F15B 13/04* (2006.01)
*F15B 13/042* (2006.01)
(Continued)

(52) U.S. Cl.
CPC ..... *F15B 13/0426* (2013.01); *E02F 9/2267* (2013.01); *E02F 9/2285* (2013.01);
(Continued)

(58) Field of Classification Search
CPC ..... F15B 13/0426; F15B 2211/355; E02F 9/2285
See application file for complete search history.

(56) References Cited

U.S. PATENT DOCUMENTS 5,333,449 A * 8/1994 Takahashi ..... E02F 9/2232 60/427
6,907,902 B2 * 6/2005 Kaneda ..... E02F 9/2004 137/596.1
(Continued)

FOREIGN PATENT DOCUMENTS

EP 1813821 A1 8/2007
JP 09-025651 A 1/1997
(Continued)

OTHER PUBLICATIONS

International Search Report (in Korean and English) and Written Opinion (in Korean) for PCT/KR2012/006507, mailed Feb. 26, 2013; ISA/KR.
(Continued)

*Primary Examiner* — Thomas E Lazo
(74) *Attorney, Agent, or Firm* — Harness, Dickey & Pierce, P.L.C.

(57) ABSTRACT

The present invention relates to a hydraulic control valve for construction machinery that is used to maintain secondary pilot pressure which is formed proportionally to the switching of a switching device so as to be equal to or below a setting pressure of a pilot pump. The hydraulic control valve of the present invention includes: a port of the pilot pump into which the pilot pressure flows; a tank port to which the pilot pressure is drained; a valve body at which a secondary pilot pressure port that selectively communicates with the port of the pilot pump and the tank port is formed; the switching device that is pivotally mounted on the valve body; a pilot control valve that is linked through pressurization of the switching device and has a spool which forms the secondary pilot pressure proportional to the amount of switching of the switching device by communicating the port of the pilot pump and the secondary pilot pressure port with each other during the switching; a valve spring that
(Continued)

elastically supports the spool so as to communicate the secondary pilot pressure port and the tank port with each other; and a check poppet that is disposed in an openable and closable manner at a pilot passage whose inlet side communicates with the secondary pilot pressure port and whose outlet side communicates with the port of the pilot pump.

3 Claims, 6 Drawing Sheets

(51) Int. Cl.
*E02F 9/22* (2006.01)
*F15B 13/02* (2006.01)
*F15B 20/00* (2006.01)

(52) U.S. Cl.
CPC ..... *F15B 13/025* (2013.01); *F15B 13/0422* (2013.01); *F15B 20/005* (2013.01); *F15B 2013/0428* (2013.01); *F15B 2211/30525* (2013.01); *F15B 2211/329* (2013.01); *F15B 2211/355* (2013.01); *F15B 2211/6355* (2013.01); *Y10T 137/7762* (2015.04)

(56) References Cited

U.S. PATENT DOCUMENTS

| | | | | |
|---|---|---|---|---|
| 7,634,961 | B2 * | 12/2009 | Asakage | E02F 9/128 60/494 |
| 9,103,355 | B2 * | 8/2015 | Ku | E02F 9/2267 |
| 2003/0084782 | A1 | 5/2003 | Kaneda et al. | |
| 2013/0228245 | A1 | 9/2013 | Ku et al. | |

FOREIGN PATENT DOCUMENTS

| | | | |
|---|---|---|---|
| JP | 2749611 | B2 | 2/1998 |
| JP | 2002-213609 | A | 7/2002 |
| JP | 2005-207499 | A | 8/2005 |
| KR | 10-0193679 | | 6/1999 |
| KR | 2010-0012008 | A | 2/2010 |

OTHER PUBLICATIONS

Extended European Search Report issued by the Eropean Patent Office (EPO) on Mar. 7, 2016 in corresponding EP patent application (6 pages).

* cited by examiner

Prior Art

Prior Art

Prior Art

Prior Art

HYDRAULIC CONTROL VALVE FOR CONSTRUCTION MACHINERY

TECHNICAL FIELD

The present invention relates to a hydraulic control valve for a construction machine. More particularly, the present invention relates to a hydraulic control valve for a construction machine in which when a shifting device is pressedly rotated to drive a traveling motor or the like, a secondary pilot pressure formed in proportion to the shifting amount of the shifting device can be prevented from exceeding a preset pressure of a pilot pump.

BACKGROUND OF THE INVENTION

A hydraulic control valve for a construction machine in accordance with the prior art as shown in FIGS. 3 to 5 includes:

a valve body 1 that includes a port Pi for a pilot pump, through which a pilot pressure is introduced, a tank port T through which the pilot pressure is drained, and a secondary pilot pressure port C configured to selectively fluidically communicate with the port Pi for the pilot pump or the tank port T;

a shifting device 3 (e.g., traveling pedal) that is rotatably mounted on the valve body 1 by means of a fixing pin 2;

a rod 4 that is configured to be shifted in cooperation with the shifting device 3 when the shifting device 3 is pressedly rotated ;

a spool 5 that is configured to be shifted in response to the shifting of the rod 4 to cause the port Pi for the pilot pump and the secondary pilot pressure port C to fluidically communicate with each other to set a secondary pilot pressure in proportion to a shifting amount of the shifting device 3; and a valve spring 6 that is configured to elastically support the spool 5 to cause the secondary pilot pressure port C and the tank port T to fluidically communicate with each other.

A hydraulic circuit used for embodying a hydraulic control valve in accordance with the prior art as shown in FIGS. 1 and 2 includes:

a main hydraulic pump 7 (hereinafter, referred to as "hydraulic pump") and a pilot pump 8, which are connected to an engine (not shown);

a hydraulic actuator 9 (e.g., traveling motor) that is connected to the hydraulic pump 7;

a main control valve (MCV) 10 that is installed in a path between the hydraulic pump 7 and the hydraulic actuator 9 and is configured to be shifted to control a start, a stop, and a direction change of the hydraulic actuator 9;

a control valve 12 that is installed in a signal pressure path 11 connected to a path 8*a* of the pilot pump 8 and is configured to be shifted to shift a spool of the main control valve 10 in a direction where the control valve 12 is shifted;

a pilot control valve 13 that is installed in the pilot pump 8 and the control valve 12 and is configured to set a secondary pilot pressure in proportion to the pressed rotation of the shifting device 3 during the shifting of the spool 5; and a relief valve 14 that is installed in the path 8*a* of the pilot pump 8 and is configured to set a discharge pressure of the pilot pump 8.

When the shifting device 3 is pressedly rotated about a fixing pin 2 in a counter-clockwise direction on the drawing sheet of FIG. 7 to drive a hydraulic actuator 9, the rod 4 is shifted to the bottom on the drawing sheet in cooperation with the shifting device to cause the spool 5 to be shifted to the bottom on the drawing sheet. At this point, the valve spring 6 receives a compressive force. For this reason, a hydraulic fluid of the port Pi side for the pilot pump 8 is transferred to the secondary pilot pressure port C after sequentially passing through an orifice 15, a first path 16, and a second path 17 in this order, so that a secondary pilot pressure is formed in a signal pressure path 11. In other words, the secondary pilot pressure formed in the signal pressure path 11 rises in proportion to a shifting amount of the shifting device 3 when the shifting device 3 is pressedly rotated downwardly.

As mentioned above, in case of the hydraulic control valve that forms the secondary pilot pressure in the signal pressure path 11 in proportion to the shifting amount of the shifting device 3, a high pressure is generated in the main control valve 10 that controls a hydraulic fluid supplied to the hydraulic actuator 9 from the hydraulic pump 7. In this case, when leakage of the hydraulic fluid occurs through a gap defined between a valve body and a spool of the main control valve 10, a hydraulic fluid from an external connection device (e.g., a hydraulic port of the main control valve) connected to the secondary pilot pressure port C can back-flow to the secondary pilot pressure port C via shifting signal paths a and b, and the signal pressure path 11. In this case, there is caused a problem in that the pilot hydraulic parts (e.g., the signal pressure path 11, a spool cap of the main control valve 10, and the like) to which the pilot pressure is supplied are damaged or a failure thereof is induced due to the high pressure formed in the secondary pilot pressure port C.

SUMMARY OF THE INVENTION

Accordingly, the present invention has been made to solve the aforementioned problems occurring in the prior art, and it is an object of the present invention to provide a hydraulic control valve for a construction machine in which when a high pressure hydraulic fluid back-flows to a secondary pilot pressure port due to leakage of a hydraulic fluid in a main control valve that controls the hydraulic fluid supplied to a hydraulic actuator, a secondary pilot pressure can be maintained below a preset pressure of a relief valve for a pilot pump.

Technical Solution

To achieve the above object, in accordance with an embodiment of the present invention, there is provided a hydraulic control valve for a construction machine, including:

a valve body including a port for a pilot pump, through which a pilot pressure is introduced, a tank port through which the pilot pressure is drained, and a secondary pilot pressure port configured to selectively fluidically communicate with the port of the pilot pump or the tank port;

a shifting device rotatably mounted on the valve body;

a rod configured to be shifted in cooperation with the shifting device when the shifting device is pressedly rotated;

a pilot control valve including a spool configured to be shifted in response to the shifting of the rod to cause the port for the pilot pump and the secondary pilot pressure port to fluidically communicate with each other to set a secondary pilot pressure in proportion to a shifting amount of the shifting device;

a valve spring configured to elastically support the spool to cause the secondary pilot pressure port and the tank port to fluidically communicate with each other;

a pilot path including an inlet that fluidically communicates with the secondary pilot pressure port and an outlet that fluidically communicates with the port of the pilot pump ; and a check poppet openably or closably installed in the pilot path so as to allow for the uni-directional movement of a hydraulic fluid from the secondary pilot pressure port to the port of the pilot pump.

In accordance with a preferred embodiment of the present invention, a traveling pedal may be used as the shifting device.

In addition, an excavator may be used as the construction machine provided with the traveling pedal.

Advantageous Effect

The hydraulic control valve for a construction machine in accordance with an embodiment of the present invention as constructed above has the following advantages.

Even when the high pressure hydraulic fluid back-flows to the secondary pilot pressure port due to leakage of the hydraulic fluid in the main control valve, the secondary pilot pressure can be maintained below the preset pressure of the relief valve for the pilot pump, so that damage or failure of pilot hydraulic parts is prevented, thereby ensuring reliability of the machine.

BRIEF DESCRIPTION OF THE DRAWINGS

The above objects, other features and advantages of the present invention will become more apparent by describing the preferred embodiments thereof with reference to the accompanying drawings, in which.

EXPLANATION ON REFERENCE NUMERALS OF MAIN ELEMENTS IN THE DRAWINGS

Figure 1:
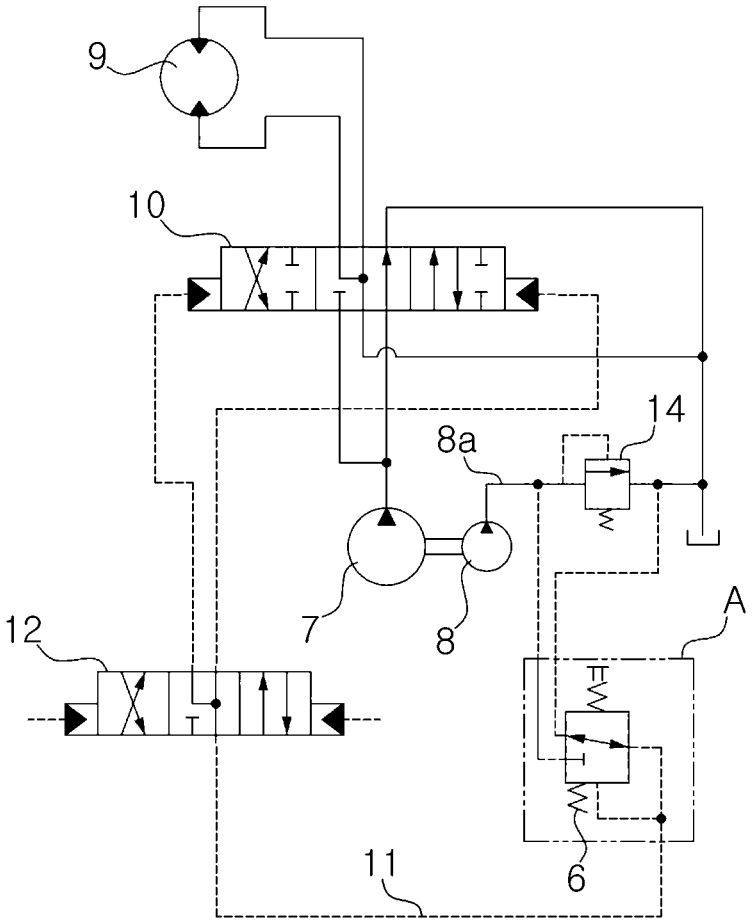
FIG. 1 is a diagram illustrating a hydraulic circuit used for embodying a hydraulic control valve for a construction machine in accordance with the prior art.
Figure 2:
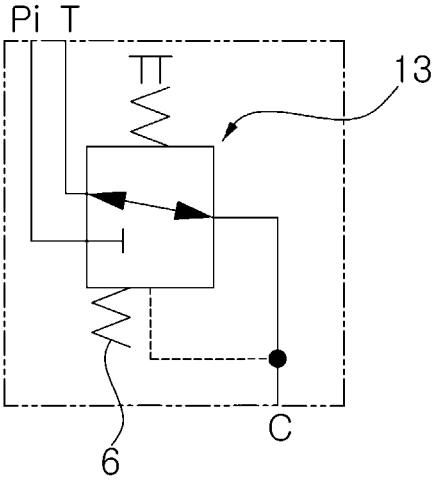
FIG. 2 is an exploded view of a region A shown in FIG. 1.
Figure 3:
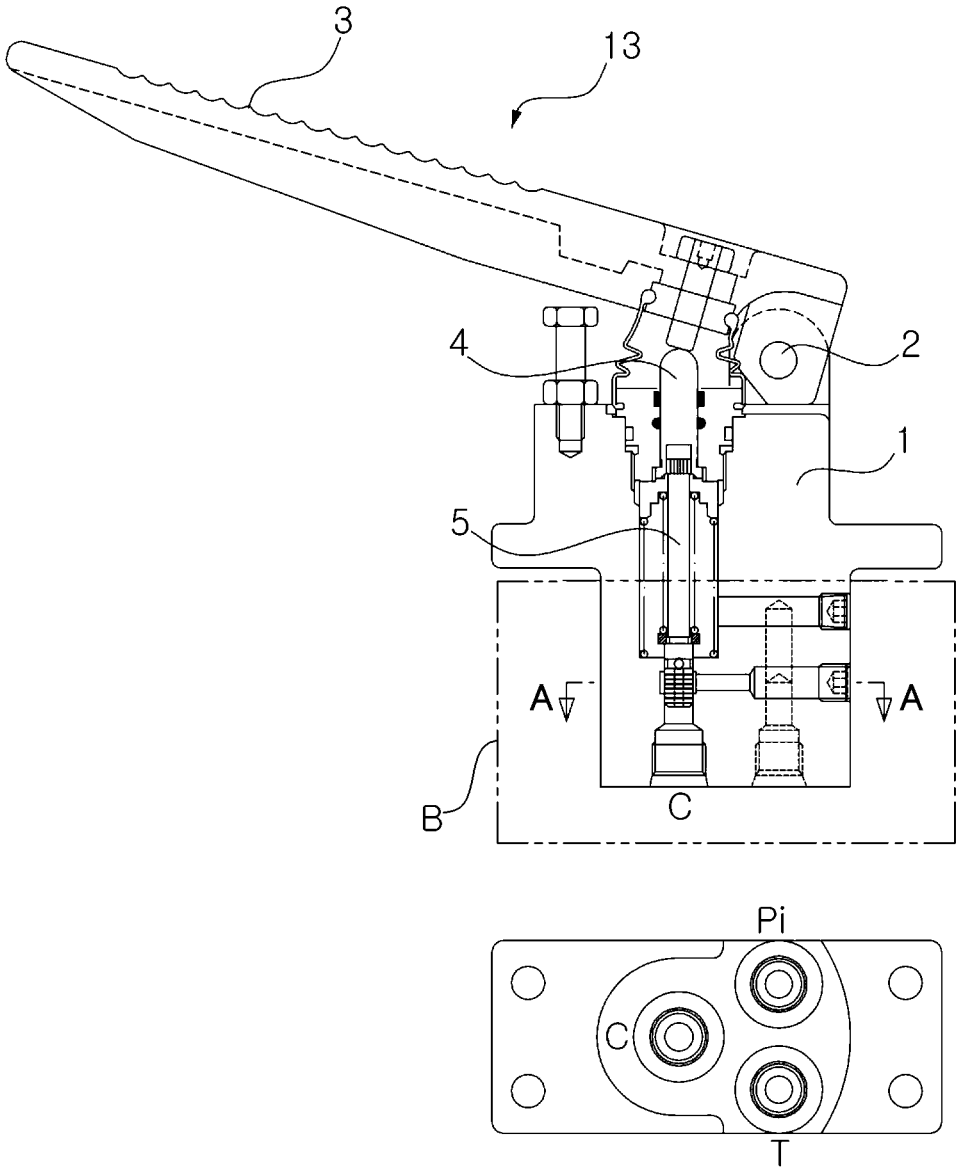
FIG. 3 is a schematic and bottom view illustrating a hydraulic control valve for a construction machine in accordance with the prior art.
Figure 4:
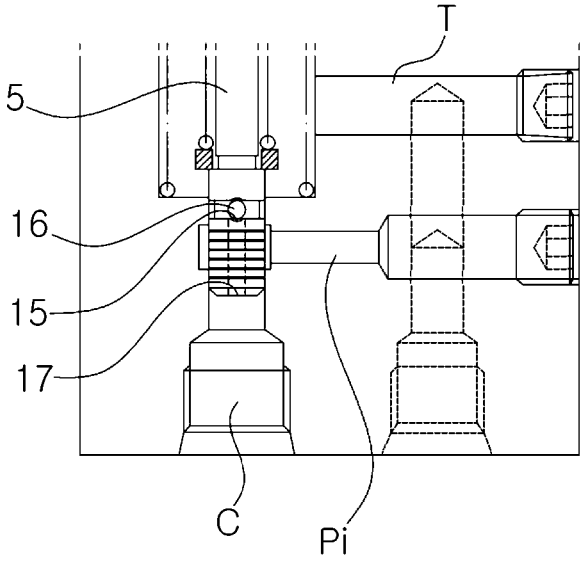
FIG. 4 is an exploded view of a region B shown in FIG. 3.
Figure 5:
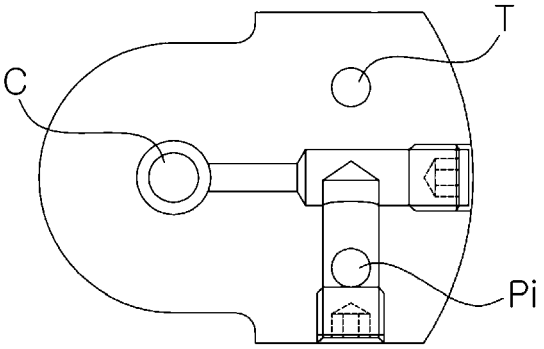
FIG. 5 is a cross-sectional view taken along the line A-A shown in FIG. 3.

1: valve body
2: fixing pin
3: shifting device
4: rod
5: spool
6: valve spring
7: main hydraulic pump
8: pilot pump
9: hydraulic actuator
10: main control valve
11: signal pressure path
12: control valve
13: pilot control valve
14: relief valve
15: orifice
16: first path
17: second pat
18: pilot path
19: check poppet
20: pilot control valve

DETAILED DESCRIPTION OF THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 6:
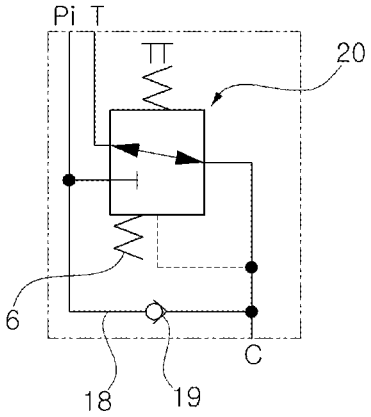
Prior Art Fig. 6
FIG. 6 is a diagram illustrating a hydraulic circuit used for embodying a hydraulic control valve for a construction machine in accordance with an embodiment of the present invention.
Figure 7:
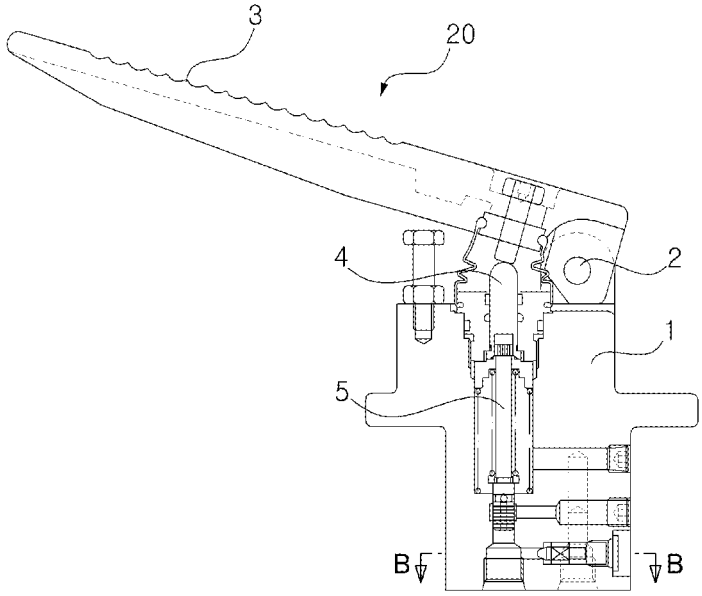
FIG. 7 is a schematic view illustrating a hydraulic control valve for a construction machine in accordance with an embodiment of the present invention.
Figure 8:
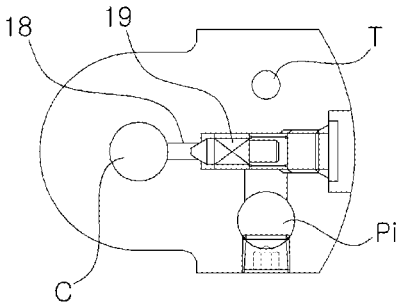
FIG. 8 is a cross-sectional view taken along the line B-B shown in FIG. 7.

A hydraulic control valve for a construction machine in accordance with an embodiment of the present invention as shown in FIGS. 6 to 8 includes:

a valve body 1 that includes a port Pi for a pilot pump, through which a pilot pressure is introduced, a tank port T through which the pilot pressure is drained, and a secondary pilot pressure port C configured to selectively fluidically communicate with the port Pi for the pilot pump or the tank port T;

a shifting device 3 that is rotatably mounted on the valve body 1 by means of a fixing pin 2;

a rod 4 that is configured to be shifted in cooperation with the shifting device 3 when the shifting device 3 is pressedly rotated about the fixing pin 2;

a pilot control valve 20 that includes a spool 5 that is configured to be shifted in response to the shifting of the rod 4 to cause the port Pi for the pilot pump and the secondary pilot pressure port C to fluidically communicate with each other to set a secondary pilot pressure in proportion to a shifting amount of the shifting device 3;

a valve spring 6 that is configured to elastically support the spool 5 to cause the secondary pilot pressure port C and the tank port T to fluidically communicate with each other;

a pilot path 18 that includes an inlet that fluidically communicates with the secondary pilot pressure port C and an outlet that fluidically communicates with the port Pi for the pilot pump; and a check poppet 19 that is openably or closably installed in the pilot path 18 so as to allow for the uni-directional movement of a hydraulic fluid from the secondary pilot pressure port C to the port Pi for the pilot pump.

In accordance with a preferred embodiment of the present invention, a traveling pedal may be used as the shifting device 3.

In addition, an excavator may be used as the construction machine provided with the traveling pedal.

In this case, a configuration of the hydraulic control valve for a construction machine in accordance with the present invention is substantially the same as that of the hydraulic control valve for a construction machine in accordance with the prior art, except the pilot path 18 and the check poppet 19. Thus, the detailed description of the same configuration and operation thereof will be omitted to avoid redundancy, and the same elements of the hydraulic control valve are denoted by the same reference numerals.

Hereinafter, the use example of a hydraulic control valve for a construction machine in accordance with an embodiment of the present invention will be described in detail with reference to the accompanying drawings.

As shown in FIGS. 1, and 6 to 8, when the shifting device 3 is pressedly rotated about a fixing pin 2 in a counterclockwise direction on the drawing sheet of FIG. 7 to drive a hydraulic actuator 9, the rod 4 is shifted to the bottom on the drawing sheet in cooperation with the shifting device to cause the spool 5 to be shifted to the bottom on the drawing sheet. At this point, the valve spring 6 receives a compressive force. For this reason, a hydraulic fluid of the port Pi side for the pilot pump 8 is transferred to the secondary pilot pressure port C after sequentially passing through an orifice 15, a first path 16, and a second path 17 in this order, so that a secondary pilot pressure in proportion to a shifting amount of the shifting device 3 is formed in a signal pressure path 11.

In this case, in the case where a main control valve 10 is shifted by the secondary pilot pressure formed in signal pressure path 11 to control a hydraulic fluid supplied to a hydraulic actuator 9 from a hydraulic pump 7, when leakage of the hydraulic fluid occurs through a gap defined between a valve body and a spool of the main control valve 10, a hydraulic fluid from a hydraulic port of the main control valve 10 can back-flow to the secondary pilot pressure port C via shifting signal paths a and b, and the signal pressure path 11.

In this case, as shown in FIG. 8, a high pressure hydraulic fluid of the secondary pilot pressure port C side causes the check poppet 19 the pilot path 18 to be shifted to the right on the drawing sheet so as to open the pilot path 18. In other words, since the secondary pilot pressure port C and the port Pi for the pilot pump fluidically communicate with each other, the high pressure hydraulic fluid that has back-flowed to the secondary pilot pressure port C from the main control valve 10 is moved to a path 8*a* of the pilot pump 8.

Accordingly, when the pressure of the high pressure hydraulic fluid moved to the path 8*a* exceeds a preset pressure, the high pressure hydraulic fluid is drained to a hydraulic tank. Thus, even when the high pressure hydraulic fluid that back-flows to the secondary pilot pressure port C from the main control valve 10, the signal pressure path 11 can maintain the preset pressure of a relief valve 14. In the meantime, the check poppet 19 does not allow the pilot pressure to be moved toward the secondary pilot pressure port C from the port Pi for the pilot pump.

As mentioned above, even when leakage of the hydraulic fluid occurs due to high pressure generated in the main control valve 10 to cause the hydraulic fluid to back-flow to the secondary pilot pressure port C, a secondary pilot pressure generated from the pilot control valve 20 maintains the preset pressure of the relief valve 14. Resultantly, it is possible to prevent damage or failure of pilot hydraulic parts due to generation of abnormal high pressure in the main control valve 10.

INDUSTRIAL APPLICABILITY

In accordance with the present invention having the above-mentioned configuration, when the shifting device is pressedly rotated to drive a traveling motor or the like, the secondary pilot pressure formed in proportion to the shifting amount of the shifting device can be maintained below the preset pressure of the pilot pump.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

The invention claimed is:

1. A hydraulic control valve for a construction machine, comprising:

a valve body including a port Pi for a pilot pump, through which a pilot pressure is introduced, a tank port T through which the pilot pressure is drained, and a secondary pilot pressure port C configured to selectively fluidically communicate with the port Pi for the pilot pump or the tank port T;

a shifting device rotatably mounted on the valve body;

a rod configured to be shifted in cooperation with the shifting device when the shifting device is pressedly rotated;

a pilot control valve including a spool that configured to be shifted in response to the shifting of the rod to cause the port Pi for the pilot pump and the secondary pilot pressure port C to fluidically communicate with each other to set a secondary pilot pressure in proportion to a shifting amount of the shifting device;

a valve spring configured to elastically support the spool to cause the secondary pilot pressure port C and the tank port T to fluidically communicate with each other;

a pilot path including an inlet that fluidically communicates with the secondary pilot pressure port C and an outlet that fluidically communicates with the port Pi for the pilot pump; and a check poppet openably or closably installed in the pilot path so as to allow for the uni-directional movement of a hydraulic fluid from the secondary pilot pressure port C to the port Pi for the pilot pump.

2. The hydraulic control valve according to claim 1, wherein a traveling pedal is used as the shifting device.

3. The hydraulic control valve according to claim 2, wherein the construction machine provided with the traveling pedal is an excavator.

* * * * *